United States Patent [19]

Tatum

[11] 4,265,725

[45] May 5, 1981

[54] ANODE CONNECTION

[75] Inventor: Joe F. Tatum, Hattiesburg, Miss.

[73] Assignee: C. E. Equipment Co., Inc., Hattiesburg, Miss.

[21] Appl. No.: 59,348

[22] Filed: Jul. 20, 1979

[51] Int. Cl.[3] ..... C23F 13/00; H01R 43/00

[52] U.S. Cl. ..... 204/196; 29/855; 29/854; 174/74 R

[58] Field of Search ..... 29/857, 860, 523, 525, 29/526 R; 403/368, 371, 374; 140/111; 174/73 R, 74 R

[56] References Cited

U.S. PATENT DOCUMENTS

| | | | |
|---|---|---|---|
| 2,009,318 | 7/1935 | Highfield | 403/371 X |
| 2,060,864 | 11/1936 | Hedler | 29/525 |
| 2,089,857 | 8/1937 | Robbins | 403/371 X |
| 2,926,128 | 2/1960 | Flower . | |
| 3,060,259 | 10/1962 | Flower et al. . | |
| 3,098,027 | 7/1963 | Flower . | |
| 3,326,791 | 6/1967 | Heuze . | |
| 3,471,395 | 10/1969 | Sumner . | |
| 4,098,663 | 7/1978 | Baboian . | |

FOREIGN PATENT DOCUMENTS

| | | | |
|---|---|---|---|
| 388523 | 3/1933 | United Kingdom | 140/111 |

*Primary Examiner*—Lowell A. Larson
*Assistant Examiner*—C. J. Arbes

[57] ABSTRACT

An apparatus for and method of making a connection between an electrical conductor and an anode so that the conductor is attached to the anode to supply electrical energy thereto for use in cathodic protection systems. The apparatus includes male and female members of electrical conducting material having cooperating frusto-conical surfaces and such members are received within a bore in an anode. Normally the male member is connected to the electrical conductor and is positioned at the bottom of the bore after which the female member is forced over the male member which causes the female member to expand into intimate engagement with the side walls of the bore. The method includes the steps of placing a male member having a frusto-conical outer surface into a bore of an anode and then forcing a female member having a cooperating frusto-conical inner surface onto the male member to cause the female member to expand into intimate engagement with the walls of the bore.

6 Claims, 11 Drawing Figures

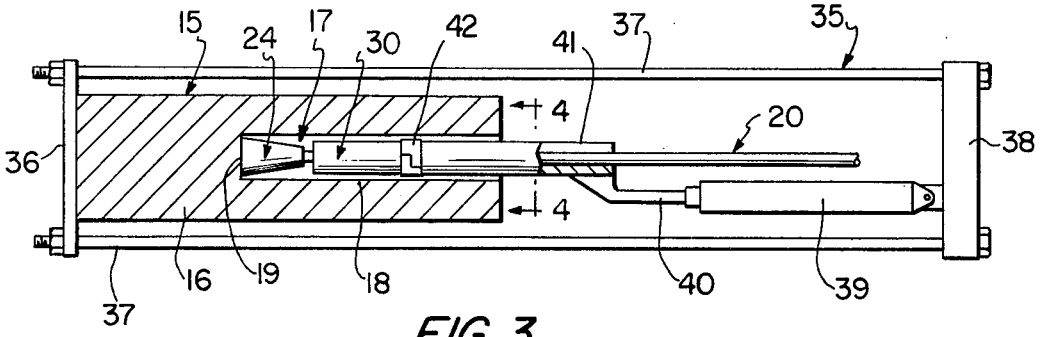
FIG. 3
FIG. 4
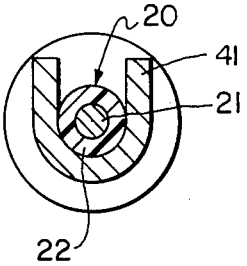
FIG. 5
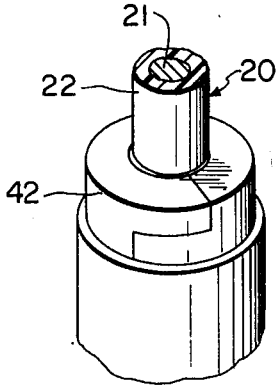
FIG. 10
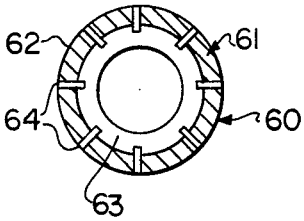
FIG. 8
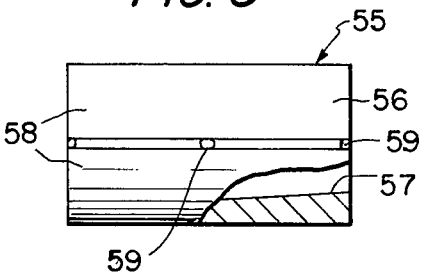
FIG. 9
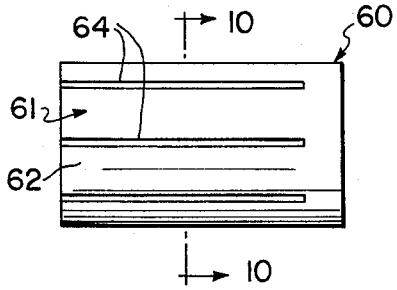
FIG. 11
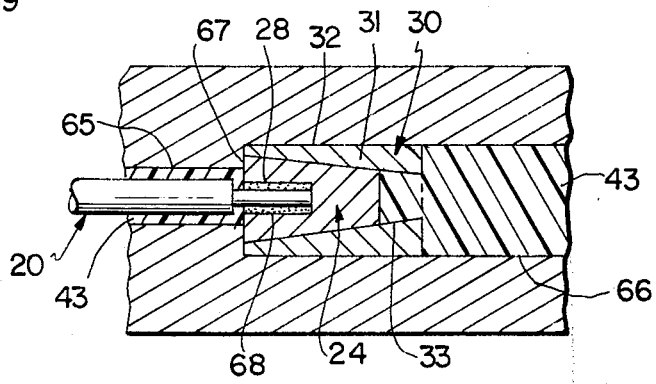

ANODE CONNECTION

SUMMARY OF THE INVENTION

In the past many efforts have been made to connect a lead wire to an anode in a cathodic protection system. Most of these efforts have been directed to connecting the lead wire to one end of the anode and some efforts have been made to connect the electrical conductor to the central portion of the anode. In some of these prior art efforts, the anode has been provided with an axial bore having threads at the inner end and the electrical conductor or lead wire has included cooperating threads so that the wire and anode could be threadedly connected together in assembled relationship. Thereafter the bore of the anode has been filled with a dielectric waterproof potting compound which excludes water from the interior of the anode. In some cases, the electrical conductor has been attached to a pin or nail which is frictionally received within a reduced portion of the bore. Additionally in some cases the anode has been provided with a bore which terminates in an undercut well or cavity in which the bared end of the electrical conductor is placed, after which solder or other electrical conducting material in a fluid state is poured into the bore and permitted to harden within the undercut cavity. Thereafter the bore is filled with a waterproof dielectric potting compound to exclude water from the interior of the anode.

The present invention is embodied in an apparatus for and method of connecting an electrical conductor to an anode in which the anode is provided with a bore extending axially inwardly from one end a relatively short distance or such bore may extend substantially to the central portion of the anode in a longitudinal direction. The apparatus includes male and female members having cooperating frusto-conical surfaces which are arranged in such a manner that the female member may be forced over the male member which causes the female member to expand into intimate engagement with the side walls of the bore of the anode. When the female member expands, substantially the entire length of the outer walls of the female member are in intimate frictional or locking engagement with the side walls of the bore and provide a low resistance flow of electrical energy from the lead wire to the anode.

The method of the present invention includes the steps of forming an inwardly extending axial bore in one end of an anode, attaching a male member having an outer frusto-conical surface to an electrical conductor, inserting the male member into the bore, placing a female member having an inner frusto-conical surface in engagement with the male member, and moving the female member longitudinally of the male member to cause the female member to expand into intimate contact with the walls of the bore.

It is an object of the invention to provide an apparatus including male and female members having cooperating frusto-conical surfaces and such members are placed within the bore of an anode after the male member is connected to an electrical conductor and thereafter the female member is forced over the male member to cause the female member to expand into intimate low resistant engagement with the bore of the anode.

Another object of the invention is to provide a method of electrically connecting one end of an electrical conductor to the interior of an anode to allow electrical current to flow readily from the conductor to the anode and which includes the steps of connecting one end of the electrical conductor to a tapered male member, placing the male member within an axial bore in the anode and then urging a female member over the male member to cause the female member to expand into engagement with the anode.

BRIEF DESCRIPTION OF THE DRAWINGS

FIG. 3 is a side elevational view illustrating one way in which the female member may be forced onto the male member.

FIG. 4 is an enlarged sectional view on the line 4—4 of FIG. 3.

FIG. 5 is a perspective view of a driving tool.

FIG. 8 is an enlarged side elevational view of a fourth embodiment of the female member.

FIG. 9 is an enlarged side elevational view of a fifth embodiment of the female member.

FIG. 10 is a sectional view taken on the line 10—10 of FIG. 9.

FIG. 11 is a fragmentary sectional view illustrating another embodiment of the invention.

DESCRIPTION OF THE PREFERRED EMBODIMENTS

Figure 1:
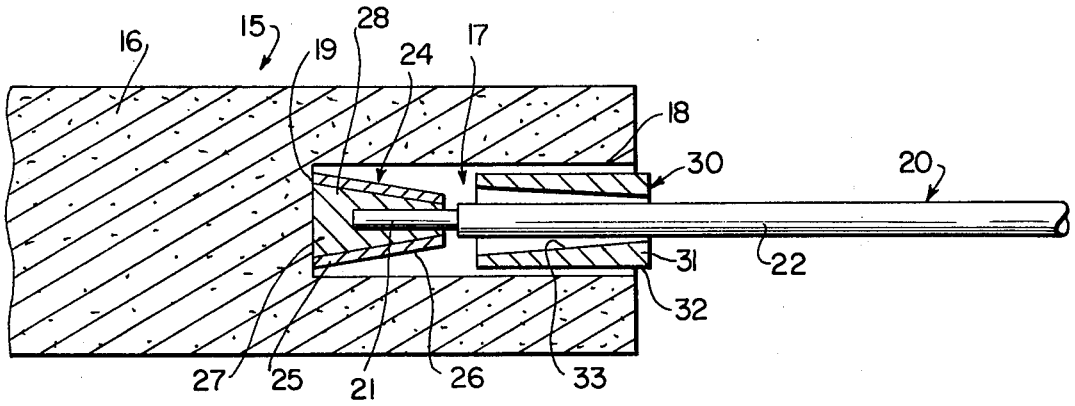
FIG. 1 is a sectional view of an anode illustrating one application of the invention before the parts are assembled.
Figure 2:
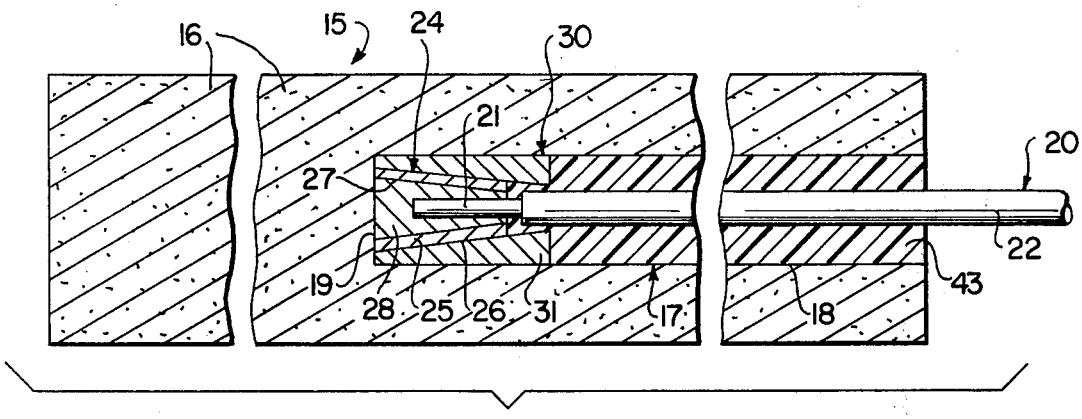
FIG. 2 is a sectional view of another embodiment showing the parts in assembled relationship.

With continued reference to the drawings, an anode 15 is provided which ordinarily is used in a cathodic protection system. Such anode preferably is constructed of graphite or other carbon material, however, other anodic materials such as copper, high silicon iron, magnesium, titanium, niobium, tantalum, or the like may be used. When titanium, niobium and tantalum are used as an anode, the outer surface is at least partially covered with a conductive material such as copper, aluminum, magnesium or one of the noble metals such as gold, silver or platinum. The anode 15 includes an elongated, slender, generally cylindrical body 16 which ordinarily is from approximately 9 inches (23 cm) to 8 feet (2.44 m) in length and from 0.375 inch (9.53 mm) to 6 inches (15.24 cm) in diameter. A bore 17 extends axially inwardly from one end of the body and such bore includes a generally cylindrical side wall 18 and a bottom wall 19. The bore 17 may extend axially inwardly of the anode for a relatively short distance, as shown in FIG. 1, or such bore could extend axially inwardly substantially to the longitudinal center of the anode, as shown in FIG. 2.

In order to supply the anode with electrical energy, an electrical conductor 20 is provided having a core 21 of copper wire or the like which is covered by a waterproof insulation 22. One end of the conductor is connected to a rectifier or other source of electrical energy (not shown) and the opposite end of such conductor is adapted to be connected to the anode. It is important that a good low resistance electrical connection be made between the conductor 20 and the anode 15 to reduce the amount of energy being supplied to the anode. To accomplish this the lower end of the insulation 22 is stripped so that the core 21 is bare. Such bared end of the conductor is inserted into a male member 24 which is constructed of electrical conducting material such as copper or the like.

The male member 24 includes a body 25 having a generally frusto-conical outer wall 26 and normally such body is hollow and includes an inner peripheral wall 27 which may be generally parallel with the outer wall 26. The bared end of the conductor 20 is inserted into the small end of the male member 24 after which such male member is filled with an electrical conducting material 28 such as solder, lead, adhesive, or the like in a molten or fluid state. When the material 28 sets or hardens, such material forms a plug which intimately engages the bared end of the conductor 20 and the inner wall 27 of the male member and provides a conducting path for electrical energy. If desired the male member 24 may have a solid generally frusto-conical body of electrical conducting material with an axial bore which receives the bared end portion of the core 21 of the conductor. Thereafter the core is secured to the body 25 in any desired manner, as by solder, electrically conductive adhesive, or the like, or, if desired, the core 21 may be secured to the body 25 by a mechanical connection such as crimping, clips, wedges, or the like.

A female member 30 having a hollow generally tubular body 31 is provided and such female member is constructed of relatively soft electrical conducting material such as copper or the like. With particular reference to FIGS. 1 and 2, the female member includes a generally cylindrical outer wall 32 and a frusto-conical inner wall 33. The frusto-conical inner wall 33 is of substantially the same taper as the outer wall 26 of the male member; however, the inner wall of the female member is slightly smaller than the tapered surface of the male member so that longitudinal movement of the female member onto the male member will cause the body 31 of the female member to expand so that the outer wall 32 of the female member intimately engages the side wall 18 of the bore of the anode.

The female member 30 is either placed on the electrical conductor 20 before the male member is secured to the end of the conductor, or the female member may be placed on the opposite end of the conductor and moved the entire length thereof until the inner wall 33 of the female member 30 engages the outer wall 26 of the male member 24. If desired, the female member 30 may be tacked to the male member 24 by a spot of soft solder or the like to maintain such members in aligned relationship, however, such tack may be easily broken.

After the male and female members are positioned on the conductor 20, the male member is inserted into the bore 17 of the anode until the male member engages the bottom wall 19 of such bore. In this position the female member is moved longitudinally of the conductor until the inner wall 33 engages the outer wall 26 of the male member, after which a longitudinal force is applied to the rear end of the female member to urge the female member onto the male member. The longitudinal force may be applied in any desired manner. As illustrated in FIGS. 3–5, the anode 15 may be placed within a frame 35 having a base 36 which is connected by a plurality of rods 37 to a head 38. A fluid cylinder 39 is mounted on the head 38 and such cylinder includes a piston rod 40 on the outer end of which is attached a generally U-shaped pusher tool 41. The pusher tool 41 is of a configuration to be received within the bore 17 of the anode and is of a cross-sectional size such that the electrical conductor 20 is received within such tool. The end of the tool remote from the fluid cylinder 39 may engage the end of the female member 30 so that when fluid is introduced into the cylinder 39 the tool exerts a longitudinal force on the end of the female member to cause the female member to slide onto the male member 24. In order to apply a substantially uniform force about the periphery of the female member, a split ring block 42 may be interposed between the end of the pusher tool 41 and the female member so that pushing force is applied to substantially the entire periphery of the female member.

As the longitudinal force is being applied to the female member, the soft material of such female member ordinarily splits as it expands and continued force causes the inner end of the female member to crumple in a manner similar to a bellows which may gouge a recess in the graphite or other material of the anode and such recess is filled with the material of the female member. If the female member does not split, such female member deforms and is expanded by the frusto-conical outer wall 26 of the body of the male member 24 so that the entire outer wall 32 of the female member is moved into intimate engagement with the side wall 18 of the anode. After the female member is firmly seated, the piston rod 40 is retracted to pull the pusher tool 41 from the bore of the anode, after which the split ring block 42 may be removed by inverting the anode to permit the block to slide out of the bore by gravity.

It is recommended that the pushing force which is applied by the fluid cylinder 39 be limited to a force which will cause the female member 30 to move lengthwise of the male member 24 but which will not be sufficiently strong to cause the anode to split. Such pushing force will vary depending upon the material of the anode.

After the male and female members have been seated and the anode has been removed from the frame 35, the annulus between the bore 17 and the electrical conductor 20 is filled with a waterproof potting compound 43 to prevent the ingress of water into the bore.

Figure 6:
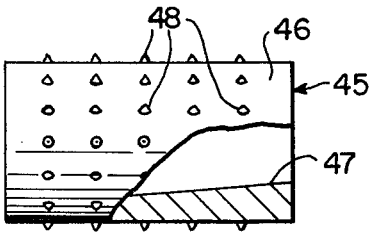
FIG. 6 is an enlarged side elevational view of a second embodiment of a female member with portions broken away.

With particular reference to FIG. 6, a female member 45 is provided which includes a generally cylindrical outer wall 46 and a tapered generally frusto-conical inner wall 47. In this embodiment the outer wall 46 may have a plurality of outwardly extending spikes or generally conical projections 48 which gouge the side wall 18 of the anode while the female member is being moved longitudinally and simultaneously the spikes may be deformed to substantially fill the gouges.

Figure 7:
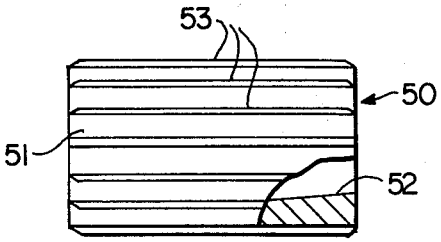
FIG. 7 is an enlarged side elevational view of a third embodiment of a female member.

With particular reference to FIG. 7, a female member 50 is provided which includes a generally cylindrical outer wall 51 and a frusto-conical inner wall 52. The outer wall 51 has a plurality of longitudinally extending ribs 53 which gouge grooves in the side wall 18 of the anode while deforming the ribs when a longitudinal force is applied.

With particular reference to FIG. 8, a female member 55 is provided having a generally cylindrical outer wall 56 and a frusto-conical inner wall 57. In this embodiment the tubular body of the female member 55 is split longitudinally to form a pair of halves 58 to permit the body to expand outwardly more easily. In order to retain the halves 58 in contiguous relationship with each other until a longitudinal force is applied, such halves may be soldered together at spaced tacks 59. The tacks preferably are of a relatively weak material such as an adhesive, soft solder, or the like.

With particular reference to FIGS. 9 and 10, a female member 60 is provided which includes a generally tubular body 61 having a generally cylindrical outer wall 62 and a frusto-conical inner wall 63. In this embodiment, the body 61 has a plurality of slits 64 extending longitudinally from one end and terminating adjacent the opposite end. The slits permit the end of the female member to expand easily into engagement with the side wall 18 of the anode bore.

With particular reference to FIG. 11, the anode 15 may have an axial bore 65 extending inwardly from one end and a concentric counterbore 66 extending inwardly from the opposite end with a shoulder 67 connecting the bore 65 to the counterbore 66. In this embodiment the male member 24 includes a substantially solid body 25 having a recess 68 extending axially inwardly from the larger end. Initially, the conductor 20 extends entirely through the anode so that the bare end may be inserted into the recess 68 where it is attached in any desired manner, as by solder, adhesive, crimping, or the like 28. Thereafter, the conductor 20 is retracted until the male member 24 rests on the shoulder 67 and the female member 30, 45, 50, 55 or 60 is inserted into the counterbore 66 and forced onto the male member 24 as previously described. After the connection has been made, the annulus between the conductor 20 and the bore 65 as well as the counterbore 66 are filled with a dielectric waterproof compound 43.

It is contemplated that if more than one anode is to be connected to the same electrical conductor 20, the cylindrical bore 17 of the anode may extend entirely through the body 16. In this event, a selected portion of the insulation 22 of the conductor is removed to expose a portion of the core 21 intermediate the ends of the conductor. Such conductor then is fed through the male member 24 until the male member surrounds the exposed portion of the core 21 and the conducting material 28 is introduced into the hollow male member to connect the inner wall 27 of the male member to the core. Thereafter, the conductor 20 is fed through the bore of the anode until the male member 24 is positioned within the bore 17 of the anode so that the female member can connect the male member 24 to the anode as previously described. When the connection has been made, both ends of the bore 17 are filled with the waterproof potting compound 43.

If desired, the anode shown in FIGS. 1 and 2 could have a smaller bore extending axially inwardly from the opposite end which communicates with the bore 17. In this event, after the male member 24 and the female member 30, 45, 50, 55 or 60 have been inserted into the bore 17, the female member may be held in position while a force applying tool could be inserted through the smaller bore to force the male member into the female member.

Also, it is apparent that the conductor 20 shown in FIGS. 1 and 2 could be attached to the larger end of the male member (as shown in FIG. 11) in which case the female member may be inserted into the bore 17 after which the male member may be inserted and a longitudinal force could be applied to the larger end of the male member to force the male member into the female member.

In the operation of the device, after the insulation 22 has been stripped from the core 21 of the electrical conductor 20, a selected female member ordinarily is placed about the electrical conductor and the bared core 21 is inserted into the hollow body 25 or the recess 68 of the male member 24. Thereafter the opening of the male member is filled with electrical conducting material 28 which secures the end of the conductor to the inner wall 27 of the male member. The male member is inserted into the bore 17 or counterbore 66 of the anode and a longitudinal force is applied to the female member to cause the frusto-conical inner wall of the female member to engage the frusto-conical outer wall 26 of the male member so that continued longitudinal movement causes the body of the female member to deform and expand into intimate low resistance contact with the side wall of the bore 17 or counterbore 66. When the pusher tool has been removed, the annulus between the side wall of the bore and the electrical conductor 20 is filled with the waterproof potting compound 43 to prevent the ingress of water.

I claim:

1. The combination of an anode and a connector for securing an electrical conductor to such anode comprising an elongated anode having a generally cylindrical bore therein of predetermined diameter, a connector for securing an electrical conductor within said bore including a first member of electrically conductive material carried within said bore of said anode, the outer wall of said first member being generally frusto-conical and having a major diameter which is less than said predetermined diameter of said bore of said anode, a second member of electrically conductive material carried within said bore and disposed around said outer wall of said first member of said connector, said second member having a generally cylindrical outer wall of a diameter less than said predetermined diameter of said bore of said anode and a generally frusto-conical inner wall, said frusto-conical inner wall of said second member having substantially the same angle of taper as the frusto-conical outer wall of said first member, said frusto-conical inner wall of said second member being in generally axially aligned relationship with the frusto-conical wall of said first member, means for connecting the electrical conductor to one of said first and second members, and said frusto-conical wall of said first member being engaged with said frusto-conical wall of said second member and causing said outer wall of said second member to expand into intimate engagement with the wall of the bore of the anode to form a low resistance electrical connection between the conductor and the anode.

2. The invention of claim 1 in which said outer wall of said second member includes at least one outwardly extending projection which gouges material from the walls of the bore of said anode and said projection is deformed to fill the gouge.

3. The invention of claim 2 in which said outwardly extending projection includes a spike.

4. The invention of claim 2 in which said outwardly extending projection includes a longitudinally extending rib.

5. The method of connecting an electrical conductor to an anode of a cathodic protection system comprising the steps of forming a bore in the body of said anode, electrically connecting said conductor to an electrically conductive male member having a generally frusto-conical outer wall, placing said male member within said bore, forcing a hollow electrically conductive female member having a generally frusto-conical inner wall and a generally cylindrical outer wall onto said frusto-conical outer wall of said male member to cause said female member to expand until said generally cylindrical wall of said female member intimately engages the wall of said bore and forms a low resistance connection therewith.

6. The method of claim 5 including the step of applying a waterproof compound to said bore after said connection has been made.

* * * * *